US005334929A

United States Patent [19]

Schade, Jr.

[11] Patent Number: 5,334,929

[45] Date of Patent: Aug. 2, 1994

[54] CIRCUIT FOR PROVIDING A CURRENT PROPORTIONAL TO ABSOLUTE TEMPERATURE

[75] Inventor: Otto H. Schade, Jr., N. Caldwell, N.J.

[73] Assignee: Harris Corporation, Melbourne, Fla.

[21] Appl. No.: 935,830

[22] Filed: Aug. 26, 1992

[51] Int. Cl.[5] ..... G05F 3/16

[52] U.S. Cl. ..... 323/315; 323/907

[58] Field of Search ..... 323/312, 315, 316, 907

[56] References Cited

U.S. PATENT DOCUMENTS

| | | | |
|---|---|---|---|
| 3,831,040 | 8/1974 | Nanba et al. | 323/315 |
| 4,029,974 | 6/1977 | Brokaw | 323/315 |
| 4,123,698 | 10/1978 | Timko et al. | 323/316 |
| 4,313,082 | 1/1982 | Neidorff | 323/312 |
| 4,348,633 | 9/1982 | Davis | 323/907 |
| 4,350,904 | 9/1982 | Cordell | 323/315 |
| 4,352,056 | 9/1982 | Cave et al. | 323/907 |
| 4,362,985 | 12/1982 | Tsuchiya | 323/907 |
| 4,593,208 | 6/1986 | Single | 323/316 |
| 4,604,568 | 8/1986 | Prieto | 323/907 |
| 4,769,588 | 9/1988 | Panther | 323/280 |
| 4,769,589 | 9/1988 | Rosenthal | 323/315 |
| 4,792,748 | 12/1988 | Thomas et al. | 323/907 |
| 4,958,122 | 9/1990 | Main | 323/315 |
| 5,068,595 | 11/1991 | Kearney et al. | 323/907 |

*Primary Examiner*—Jeffrey L. Sterrett

*Attorney, Agent, or Firm*—Henry I. Schanzer; Fedinand Romano; C. C. Krawczyk

[57] ABSTRACT

An integrated circuit for providing a current proportional to absolute temperature comprises circuitry for providing a first current exhibiting substantially zero temperature coefficient; circuitry for providing a second current exhibiting a negative temperature coefficient; and circuitry for summing the first and second currents for providing a third current proportional to absolute temperature.

16 Claims, 1 Drawing Sheet

CIRCUIT FOR PROVIDING A CURRENT PROPORTIONAL TO ABSOLUTE TEMPERATURE

FIELD OF THE INVENTION

The present invention relates to current biasing circuitry and, more particularly, to biasing circuitry as may be useful in integrated circuit (IC) technology for providing a current whose magnitude is proportional to absolute temperature (PTAT), generally referring to the operating temperature of the component parts of the circuitry.

BACKGROUND OF THE INVENTION

It is known in the art (to which the present invention pertains) that useful and desirable circuit functions may be achieved by the utilization of a current or a plurality of currents whose magnitude remains proportional to the absolute temperature of the circuit components. For example, such currents having a magnitude proportional to absolute temperature (PTAT) find application in circuitry designed to provide a constant voltage reference, such as a band-gap reference circuit or, for another example, in circuitry intended to operate as an electronic thermometer for providing a signal representative of temperature. The need for such PTAT current circuits is thus known to exist.

Among the existing technologies, various bipolar technologies for "precision" circuits utilize thin-film resistors in the implementation of proportional to absolute temperature circuits. The reasons for this practice include the fact that such thin-film resistors exhibit a temperature coefficient of resistance that is negligibly small, being considerably smaller than, for example, the temperature coefficient of resistance of an integrated doped resistor as formed in integrated circuit technology. Thus, in the more generally used, less expensive integrated circuit technologies, an integrated resistor exhibits a positive temperature coefficient of resistance typically in the range of 1200 to 1500 parts per million per degree Celsius (ppm/°C.) or greater. When diffusion implanting is utilized with a resistivity in the range of 200 to 2000 ohms per square, a diffused resistor may then exhibit a temperature coefficient of resistance in the order of 3000 to 5000 parts per million per degree Celsius (or per degree Kelvin).

Circuit arrangements are readily provided for deriving a voltage proportional to absolute temperature. Such a voltage may be obtained by taking the difference voltage between the forward-biased base emitter junction voltages (Vbe's) of two bipolar transistors being operated at different emitter current densities. The difference voltage is then applied to the ends of a resistor. If the resistor exhibits a temperature coefficient of resistance that is not too great, then the current in the resistor resulting from the applied voltage difference will exhibit the desired proportionality to absolute temperature.

As is known in the art, the temperature coefficient of the difference voltage between the forward-biased base emitter junction voltages of two bipolar transistors being operated at different emitter current densities in fixed ratio is in the order of 3300 parts per million per degree Celsius. Thus, the temperature coefficient of the voltage is in the order of the temperature coefficient of integrated resistors, as described above. Accordingly, the application to such a resistor of a voltage that is proportional to absolute temperature will, in general, result in a current that is reasonably constant with temperature or which may even exhibit a negative temperature coefficient. While a relatively constant current may be appropriate for the operation of such circuit arrangements for deriving a voltage proportional to absolute temperature, a current proportional to absolute temperature is not thereby obtained.

SUMMARY OF THE INVENTION

In accordance with an aspect of the invention, an integrated circuit for providing a current proportional to absolute temperature comprises:

a first circuit arrangement for providing a first current exhibiting substantially zero temperature coefficient;

a second circuit arrangement for providing a second current exhibiting a negative temperature coefficient; and circuitry for summing the first and second currents for providing a third current exhibiting a positive temperature coefficient.

In accordance with another aspect of the invention, the third current is proportional to absolute temperature.

In accordance with another aspect of the invention, the first circuit arrangement comprises a feedback loop including current mirror circuitry exhibiting a current dependent mirroring ratio, the ratio being greater for smaller currents.

In accordance with another aspect of the invention, the second circuit arrangement comprises a resistor exhibiting a positive temperature coefficient of resistance and circuitry for providing a voltage exhibiting a negative temperature coefficient and for applying the voltage exhibiting a negative temperature coefficient across the resistor.

In accordance with another aspect of the invention, the first current is of greater magnitude than the second current.

In accordance with yet another aspect of the invention, an integrated circuit for providing a current proportional to absolute temperature comprises:

a current summing node for providing an output current to a load;

a transistor having emitter, base, and collector electrodes, the collector electrode being connected to the summing node for providing a first current thereat;

a resistor, exhibiting a positive temperature coefficient of resistance, having a first end connected to the emitter electrode and having a second end;

circuitry for applying between the second end of the resistor and the base electrode a voltage exhibiting a negative temperature coefficient for causing the first current to exhibit a negative temperature coefficient; and circuitry having an output connected to the summing node for providing thereat a second current of opposite polarity sense to, and of magnitude greater than, the collector current, the second current exhibiting a small temperature coefficient in comparison with the negative temperature coefficient such that the summed output current exhibits a positive temperature coefficient.

In accordance with still another aspect of the invention, an integrated circuit for providing a current proportional to absolute temperature, comprises:

a feedback loop of first and second current mirror amplifiers of opposite polarity types being interconnected with an output of each current mirror amplifier being connected to the input of the other so as to exhibit a loop gain, at least one of the current mirrors including resistive emitter degeneration in an output transistor thereof so as to exhibit a current gain diminishing with current increase, the loop gain exceeding unity at a first, smaller current and dropping to unity at a second, greater current for stable operation thereat such that the second current is substantially independent of temperature;

circuitry coupled to one of the current mirror amplifiers for providing a third current proportional to the second current;

circuitry for providing a fourth current exhibiting a negative temperature coefficient; and summing circuitry for providing an output current equal to the difference between the third and fourth currents.

BRIEF DESCRIPTION OF THE DRAWING

The invention will be more clearly understood by the description following of preferred embodiments, in conjunction with the drawing in which.

DETAILED DESCRIPTION OF PREFERRED EMBODIMENTS

Figure 1:
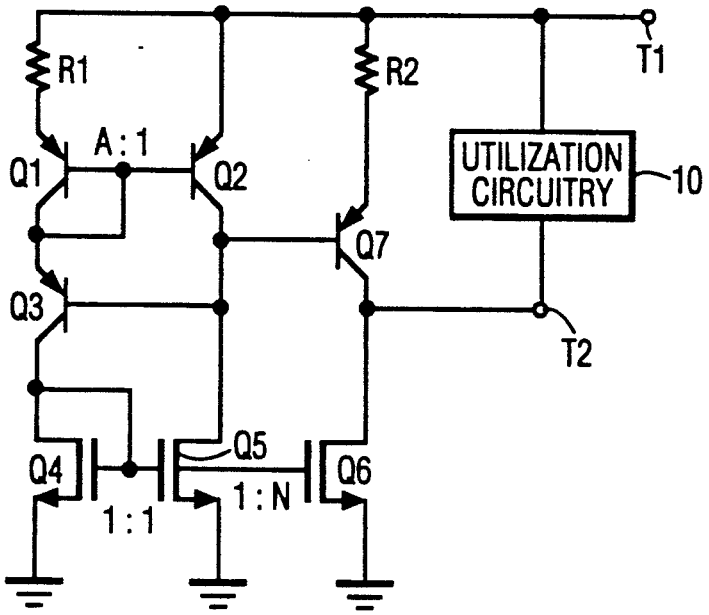
FIG. 1 shows in schematic form a circuit arrangement in accordance with the invention.

Referring to FIG. 1, transistors Q1, Q2, Q3, Q4, and Q5 are formed in an integrated circuit and are arranged in a feedback loop arrangement which is known to provide a voltage that is proportional to absolute temperature across a resistor R1. Transistors Q1, Q2, and Q3 are PNP bipolar transistors having respective emitter, base, and collector electrodes, wherein transistors Q1 and Q2 have their respective emitter-base junctions in the ratio of A: 1, where A is greater than 1. Transistor Q1 has its base electrode connected to its own collector electrode and further connected to the base electrode of transistor Q2. Transistor Q2 has its emitter electrode connected to a supply rail for receiving a positive operating voltage at a terminal T1, the negative rail being herein indicated throughout as "ground". The emitter electrode of transistor Q1 is connected to the supply rail by way of resistor R1 which is an integrated resistor. Diode-connected transistor Q1 thus forms the "master" or reference "diode" of a current mirror amplifier in conjunction with transistor Q2.

The emitter electrode of transistor Q3 is connected to the collector electrode of transistor Q1 and its base electrode is connected to the collector electrode of transistor Q2.

Transistors Q4 and Q5 are N-channel insulated gate field effect transistors (e.g. MOSFET's) having respective source, gate, and drain electrodes and having identical geometries as indicated in FIG. 1 by the annotation "1: 1". The source electrodes of transistors Q4 and Q5 are connected to ground. The gate electrode of transistor Q4 is connected to its own drain electrode and to the gate electrode of transistor Q5. Thus, transistors Q4 and Q5 form together a current mirror amplifier, with a drain current applied to the drain electrode of transistor Q4 being replicated in the drain current of transistor Q5. The ratio of the drain currents of transistors Q4 and Q5 will be unity as a result of their identical geometries. A further N-channel insulated gate field effect transistor Q6 has a geometry of N times that of transistors Q4 and Q5 and has its source electrode connected to ground and its gate electrode connected to the gate electrodes of transistors Q4 and Q5. Thus, transistor Q6 forms a current mirror with the master diode-connected transistor Q4 and, because of its geometry ratio with transistor Q4, its drain current will be N times the drain current of transistor Q4 or transistor Q5.

The collector electrode of transistor Q3 is connected to the drain electrode of transistor Q4 and the collector electrode of transistor Q2 is connected to the drain electrode of transistor Q5. A further PNP transistor Q7 has its emitter electrode connected to the supply rail by way of a resistor R2 which is an integrated resistor and its base electrode connected to the base electrode of transistor Q3. The collector electrode of transistor Q7 is connected to the drain electrode of transistor Q6 and to an output terminal T2. Current utilization circuitry 10 is connected between output terminal T2 and the positive supply rail.

In operation, the feedback loop formed by transistors Q1, Q2, Q3, Q4, and Q5 will exhibit a loop gain of A at very small currents. The current around the loop will accordingly increase until the loop gain falls to unity by reason of the voltage developed across resistor R1. At this point, the loop current will be stabilized at a value where the voltage drop across resistor R1 has reached a value equal to the difference voltage between the forward-biased base emitter junction voltages of transistors Q1 and Q2 which are being operated at a different emitter current densities. Such a mode of operation is known, for example, from U.S. Pat. No. 4,123,698, issued Oct. 31, 1978 in the name of Brokaw et al., the disclosure of which is hereby incorporated herein by reference. In accordance with this known mode of operation, the voltage across resistor R1 is known to be proportional to absolute temperature and to exhibit a positive temperature coefficient in the order of 3300 parts per million per degree Celsius.

The current through resistor R1 and consequently the current around the loop formed by transistors Q1, Q2, Q3, Q4, and Q5 will exhibit a temperature coefficient of about zero, that is, it will remain substantially constant with temperature because of the positive temperature coefficient of resistor R1 which approximately equals the temperature coefficient of the voltage across it.

Thus, the drain current of transistor Q6, which mirrors the loop current multiplied by a factor N, will also remain substantially constant with temperature.

Considering now transistor Q7, it is seen that its base electrode potential is at 2 Vbe's below the supply rail potential, being the Vbe of Q2 plus the Vbe of Q3. Accordingly, the voltage appearing across resistor R2 will be 1 Vbe. It is known in the art that Vbe exhibits a negative temperature coefficient. Because R2 is an integrated resistor it will exhibit a positive temperature coefficient of resistance (of about 3300 parts per million per degree Celsius). For both reasons, the current through resistor R2 will exhibit a negative temperature coefficient.

The connections to the collector electrode of transistor Q7, the drain electrode of transistor Q6, and terminal T2 form a current summing node. By Kirchhoff's current law, the output current flowing from utilization circuitry 10 by way of terminal T2 is equal to the drain current of transistor Q6, which exhibits essentially zero temperature coefficient, minus the collector current of transistor Q7, which exhibits a negative temperature coefficient, N being selected to make the drain current of transistor Q6 greater than the collector current of transistor Q7. The output current through utilization circuitry 10, being the difference current, will then exhibit the desired positive temperature coefficient.

By appropriate selection of the ratio between the drain current of transistor Q6 and the collector current of transistor Q7, the output current can be made to be proportional to absolute temperature over a wide range of variation of the positive temperature coefficients of resistance of the integrated resistors R1 and R2.

For proper operation, terminal T2 must operate within a compliance range of potential: a range of potential defined to be above the saturation voltage of transistor Q6 and below the supply rail potential by Vbe plus the saturation voltage of transistor Q7. This represents a wide range of operation.

Figure 2:
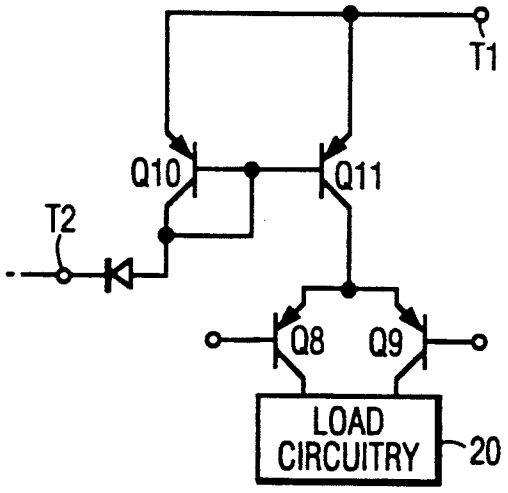
FIG. 2 shows a load arrangement for an embodiment wherein the load is connected to the embodiment shown in FIG. 1.

It is herein recognized that a utilization circuitry 10 may usefully comprise a pair of NPN transistors connected as a differential pair or, for example, a pair of PNP transistors, Q8 and Q9, connected as a differential pair to load circuitry 20 and provided with a suitable current mirror, comprising transistors Q10 and Q11, as shown in FIG. 2. It is known that the mutual conductance for a constant tail current of such a differential pair drops linearly with absolute temperature. Thus, when provided by way of T2 with an appropriate tail current that is proportional to absolute temperature, the differential pair can be arranged to exhibit relatively constant mutual conductance.

The invention has been described by way of exemplary embodiments. Various changes and modifications will be apparent to one of skill in the art. For example, the combination of N-MOS field effect transistors and bipolar devices are conveniently used herein for illustrating the invention because they are available in BIMOS-E technology. However, the N-MOS devices can be replaced with NPN bipolar transistors. Similarly, the circuit can be constructed with complementary polarity devices. Furthermore, the current mirrors can be replaced with other equivalents as is known to those skilled in the art. These and like changes and alterations are intended to be within the spirit and scope of the invention as defined by the claims following the appendix hereto.

APPENDIX

A calculation for a typical application is provided as an illustration.

Let the collector current of transistor Q7 be 17, so that $$I7 = Vbe/R2, \text{ where } Vbe = 1.2 - 2\times10^{-3}(T)$$

then, at 300° K., $Vbe_{300} = 1.2 - 0.6 = 0.6$ volt and $I7_{300} = 0.6/R_{300}$, where $R_{300}$ represents the value of an integrated resistor at 300° K.

At 400° K., $Vbe_{400} = 1.2 - 0.8 = 0.4$ volt; and for 3300 ppm/°C. resistors, $R_{400} = 1.333\ R_{300}$.

Therefore, $I_{400}/I_{300} \approx 0.4/(1.333\ R_{300}) \times R_{300}/0.6 = 0.50$, thereby indicating that $I7_{400}$ is one-half of $I7_{300}$ To achieve a current output proportional to absolute temperature based upon the assumption made that I6, drain current of transistor Q6, is constant with temperature, the nodal equations for summing node S are $$@\ 300°\ K.,\ I6 - I7 = I_{out} = I_{PTAT}$$

$$@\ 400°\ K.,\ I6 - 0.5I7 = (4/3)I_{out} = (4/3)I_{PTAT}$$

This reduces to I7/I6=0.40 at 300° K.

Very reasonable resistor values can then be selected in practice to result in this 300° K. relationship.

Considering the case of BIMOS-E technology, the temperature coefficient for resistors is about 4000 ppm/°C.

Approximating, $$\Delta Vbe_{400} \approx \Delta Vbe_{300} \times (4/3)$$

$$R_{400} = 1.4R_{300}$$

$$I6_{400}/I6_{300} \approx 0.95,$$

and the nodal equations become $$@\ 300°\ K.,\ I6 - I7 = I_{out}$$

$$@\ 400°\ K.,\ 0.95I6 - 0.48I7 = (4/3)I_{out}$$

resulting in I7/I6=0.45@300° K. for the design criterion.

I claim:

1. An integrated circuit for providing a current proportional to absolute temperature, comprising:

current mirror means for producing a reference current;

a first circuit means coupled between said current mirror means and a summing node for providing thereto a first current exhibiting substantially zero temperature coefficient;

second circuit means coupled between said current mirror means and said summing node for providing thereto a second current exhibiting a negative temperature coefficient; and output means coupled to said summing node for summing said first and second currents for providing and carrying a third current through said output means exhibiting a positive temperature coefficient.

2. An integrated circuit in accordance with claim 1, wherein said third current is proportional to absolute temperature.

3. An integrated circuit in accordance with claim 2, wherein said current mirror means includes first and second current mirror amplifiers (CMAs) interconnected in a feedback loop and exhibiting a current dependent mirroring ratio, said ratio being greater for smaller currents; and wherein one of said CMAs includes field-effect transistors and the other one includes bipolar transistors.

4. An integrated circuit in accordance with claim 3, wherein said second circuit means comprises a resistor exhibiting a positive temperature coefficient of resistance and means for providing a voltage exhibiting a negative temperature coefficient and for applying said voltage exhibiting a negative temperature coefficient across said resistor.

5. An integrated circuit in accordance with claim 1, wherein said first current is of greater magnitude than said second current.

6. The integrated circuit as claimed in claim 1, including first and second power supply rails; and wherein said current mirror means includes first and second current mirror amplifiers (CMAs) of complimentary conductivity, each CMA having a reference terminal, a first input terminal and a second output terminal; and wherein the first CMA is coupled at its reference terminal to said first rail, at its input terminal to a first node and at its output terminal to a second node; and wherein said second CMA is coupled at its reference terminal to said second rail, at its input terminal to said first node and at its output terminal to said second node.

7. The integrated circuit as claimed in claim 6, wherein said first circuit means includes a first transistor having a control electrode and a main conduction path, the control electrode of said first transistor being coupled to said first node and its main conductor path being coupled between said summing node and said second rail;

wherein said second circuit means includes a second transistor having a control electrode and a main conduction path, the control electrode of said second transistor being coupled to said second node; and said second circuit means including a resistor connected in series with the main conduction path of said second transistor between said first rail and said summoning node.

8. The circuit as claimed in claim 7, wherein said first transistor is a field-effect transistor and wherein said second transistor is a bipolar transistor; and wherein said series connected resistor is connected between the emitter of said second transistor and said first rail.

9. An integrated circuit for providing a current proportional to absolute temperature, comprising:

a current summing node for providing an output current to a load;

a transistor having emitter, base, and collector electrodes, said collector electrode being connected to said summing node for providing a first current thereat;

a resistor, exhibiting a positive temperature coefficient of resistance, having a first end connected to said emitter electrode and having a second end;

current mirror means for producing a reference current and also having a node at which is produced a voltage exhibiting a negative temperature coefficient;

means coupled to said node for applying between said second end of said resistor and said base electrode said voltage exhibiting a negative temperature coefficient for causing said first current to exhibit a negative temperature coefficient; and circuit means, coupled to said current mirror means, having an output connected to said summing node for providing thereat a second current, responsive to said reference current, of opposite polarity sense to, and of magnitude greater than, said first current, said second current exhibiting a small temperature coefficient in comparison with said negative temperature coefficient such that said output current exhibits a positive temperature coefficient.

10. An integrated circuit in accordance with claim 9, wherein said output current is proportional to absolute temperature; and wherein said current mirror means includes bipolar transistors and field-effect transistors.

11. An integrated circuit in accordance with claim 10, wherein said second current exhibits substantially no temperature coefficient; and wherein the bipolar transistors are of opposite conductivity type to the field effect transistors.

12. An integrated circuit in accordance with claim 9, wherein said circuit means includes an output transistor of opposite conductivity type to said first-named transistor.

13. An integrated circuit for providing a current proportional to absolute temperature, comprising:

a feedback loop of first and second current mirror amplifiers of opposite polarity types being interconnected with an output of each current mirror amplifier being connected to the input of the other so as to exhibit a loop gain, at least one of said current mirrors including resistive means for providing resistive emitter degeneration in an output transistor thereof so as to exhibit a current gain diminishing with current increase, said loop gain exceeding unity at a first, smaller current and dropping to unity at a second, greater current for stable operation thereat such that said second current is substantially independent of temperature;

mirroring means coupled between one of said current mirror amplifiers and a summing node for providing thereto a third current proportional to said second current;

means coupled between one of said current mirror amplifiers and said summing node for providing thereto a fourth current exhibiting a negative temperature coefficient; and summing output means coupled to said summing node for providing an output current through said output means equal to the difference between said third and fourth currents.

14. An integrated circuit in accordance with claim 13, wherein said feedback loop includes a node at voltage of 2 Vbe with respect to a supply rail and including a transistor having emitter, base, and collector electrodes and being of a conductivity type for providing a collector current of opposite polarity sense to said third current; a resistor of positive temperature coefficient of resistance connected between said supply rail and said emitter electrode; said base electrode being connected to said node and said collector being connected to said summing means.

15. An integrated circuit in accordance with claim 13, wherein said third current is greater than said fourth current and wherein said output current is proportional to absolute temperature.

16. An integrated circuit in accordance with claim 13, wherein said resistive means exhibits a positive temperature coefficient of resistance.

* * * * *